US008656555B2

(12) United States Patent
Brown

(10) Patent No.: US 8,656,555 B2
(45) Date of Patent: Feb. 25, 2014

(54) DEVICE PREVENTING DOORS FROM CLOSING AND LOCKING

(76) Inventor: Shaun Brown, Amityville, NY (US)

( * ) Notice: Subject to any disclaimer, the term of this patent is extended or adjusted under 35 U.S.C. 154(b) by 0 days.

(21) Appl. No.: 13/468,021

(22) Filed: May 9, 2012

(65) Prior Publication Data

US 2012/0284963 A1 Nov. 15, 2012

Related U.S. Application Data

(60) Provisional application No. 61/484,375, filed on May 10, 2011.

(51) Int. Cl.
*E05F 5/06* (2006.01)

(52) U.S. Cl.
USPC ..... 16/85; 16/82

(58) Field of Classification Search
USPC ..... 16/82, 83, 86 R, 86 A, 86 B; 292/289, 292/297, 298, 338, 339, 342, DIG. 15, 262
See application file for complete search history.

(56) References Cited

U.S. PATENT DOCUMENTS

| | | | | | |
|---|---|---|---|---|---|
| 1,876,881 | A | * | 9/1932 | Durant | 292/288 |
| 2,042,297 | A | * | 5/1936 | Craighead | 292/87 |
| 3,357,732 | A | * | 12/1967 | Seal | 292/60 |
| 4,815,215 | A | * | 3/1989 | Saylor et al. | 33/197 |
| 5,123,685 | A | * | 6/1992 | Donovan | 292/262 |
| 5,291,631 | A | | 3/1994 | Schjoneman | |
| D367,421 | S | * | 2/1996 | Powers | D8/402 |
| 5,524,684 | A | * | 6/1996 | Stuckel | 144/144.51 |
| 5,850,172 | A | | 12/1998 | Lenz et al. | |
| 6,317,047 | B1 | | 11/2001 | Stein et al. | |
| 6,327,743 | B1 | | 12/2001 | Rashid et al. | |
| 6,550,828 | B2 | | 4/2003 | Warden | |
| 2004/0055220 | A1 | | 3/2004 | Lohman | |

FOREIGN PATENT DOCUMENTS

| | | | |
|---|---|---|---|
| GB | 2190135 | A | * 11/1987 |
| GB | 2388066 | A | * 11/2003 |

* cited by examiner

*Primary Examiner* — Chuck Mah
(74) *Attorney, Agent, or Firm* — The Farrell Law Firm, P.C.

(57) ABSTRACT

A door locking prevention device can be placed on a door to prevent the door from closing tight and locking. The door locking prevention device may be useful for first responders so that, upon passing through a door, then can be assured that exit back through the door is not prevented due to the door closing and locking. The door locking prevention device may include a feature where, once installed on a door, removal without an appropriate tool or key is difficult or impossible. The door locking prevention device includes two members that can be tightened together to clamp on an outer periphery of a door, preventing the door from closing fully. The door locking prevention device may include a lamp, strobe, GPS locator or other feature to help find deployed devices.

5 Claims, 3 Drawing Sheets

DEVICE PREVENTING DOORS FROM CLOSING AND LOCKING

CROSS-REFERENCE TO RELATED APPLICATIONS

This application claims the benefit of priority of U.S. provisional patent application No. 61/484,375 filed May 10, 2011, the contents of which are herein incorporated by reference.

BACKGROUND OF THE INVENTION

The present invention relates to door accessories and, more particularly, to a door locking device for emergency first responders, for example, that prevents doors from closing and locking.

In the course of their work, emergency first responders routinely enter and exit buildings. When they enter a building, or a room in a building, it is important that the first responder maintain an open exit. Some doors, such as roof access doors, may allow a user to exit onto the roof, but may not permit reentry into the building if the door closes tight.

Conventional ways to keep doors open, or prevent them from closing and locking, may include placing objects in front of the door, placing a wedge or other object into the door jamb, or the like. These methods, however, can be thwarted by other first responders moving objects intentionally or unintentionally, or by persons with malicious intent to prevent first responders from backtracking through a previously opened door.

As can be seen, there is a need for a device to prevent a door from closing and locking that cannot be easily removed once installed on a door.

SUMMARY OF THE INVENTION

In one aspect of the present invention, a door locking prevention device comprises a first bracket having a male member extending therefrom; a second bracket having a female member extending therefrom, wherein the male member fits inside the female member; a threaded bolt extending into the female member; a threaded connector disposed in the male member, the threaded connector adapted to threadably engage with the threaded bolt; and a spring disposed about the threaded bolt, the spring adapted to push the first bracket away from the second bracket.

In another aspect of the present invention, a door locking prevention device comprises a first bracket having an L-shape and a male member extending therefrom; a second bracket having an L-shape and a female member extending therefrom, wherein the male member fits inside the female member; a threaded bolt extending into the female member; a threaded connector disposed in the male member, the threaded connector adapted to threadably engage with the threaded bolt; a spring disposed about the threaded bolt, the spring adapted to push the first bracket away from the second bracket; and a locking mechanism to prevent the first bracket from being separated from the second bracket, even when the threaded bolt is unthreaded from the threaded connector.

These and other features, aspects and advantages of the present invention will become better understood with reference to the following drawings, description and claims.

DETAILED DESCRIPTION OF THE INVENTION

Figure 1:
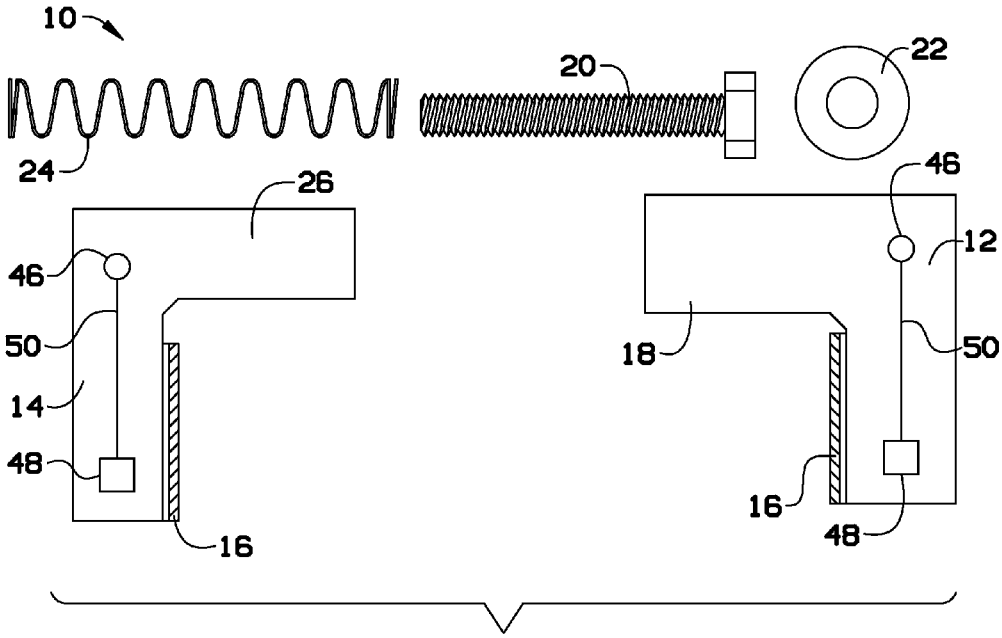
FIG. 1 is an exploded perspective view of a door locking prevention device according to an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a door locking prevention device that can be placed on a door to prevent the door from closing tight and locking. The door locking prevention device may be useful for first responders so that, upon passing through a door, then can be assured that tactical retreat back through the door is not prevented due to the door closing and locking. The door locking prevention device may include a feature where, once installed on a door, removal without an appropriate tool or key is difficult or impossible. The door locking prevention device includes two members that can be tightened together to clamp on an outer periphery of a door, preventing the door from closing fully. The door locking prevention device may include a lamp, strobe, GPS locator or other feature to help find deployed devices.

Referring to FIGS. 1 through 4, a door locking prevention device 10 may include bracket members 12, 14, shaped generally in an L-shape, having a male member 26 and a female member 18, where the male member 26 is adapted to fit inside of the female member 18. Along an inside edge of the bracket members 12, 14, a padding element 16 may be disposed. The padding element 16 may help prevent the bracket members 12, 14 from marking a door when the door locking prevention device 10 is applied to the door.

A bolt 20 may fit into the female member 18 and extend generally parallel to the axis of the female member 18. A nut 28, or some other threaded member adapted to accept the threads of the bolt 20, may be disposed inside the male member 26. When the male member 26 is inserted into the female member 18, the threads of the bolt 20 may engage with the nut 20 and turning the bolt 20 may cause the distance between the padding elements 16 of the bracket members 12, 14 to decrease. A washer 22 may be disposed adjacent a head of the bolt 20.

A spring 24 may be disposed along the bolt 20 inside the female member 18 such that the spring 24 resiliently maintains the bracket members 12, 14 at their farthest distance apart. This configuration allows a user to pre-assembly the bracket members 12, 14 together with the bolt 20 and nut 28 and easily apply the door locking prevention device 10 to a door without the bracket members 12, 14 closing together by simply sliding together.

Figure 2:
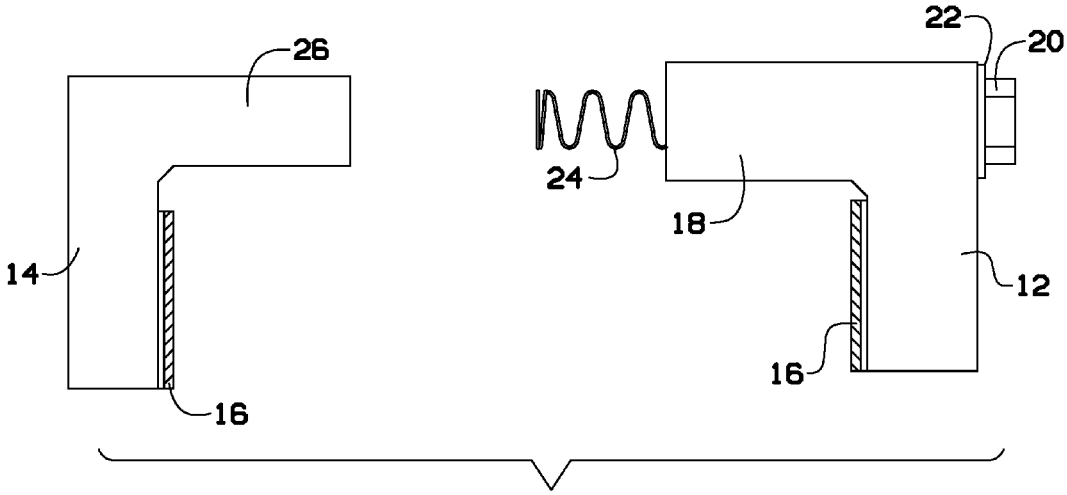
FIG. 2 is a perspective view of the door locking prevention device of FIG. 1 prior to assembly on a door.
Figure 3:
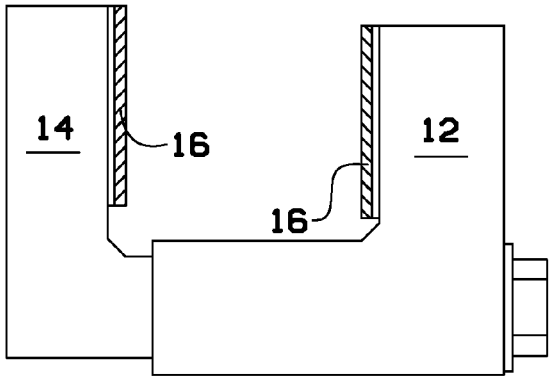
FIG. 3 is a side view of the door locking prevention device of FIG. 1 in a fully tightened state.
Figure 4:
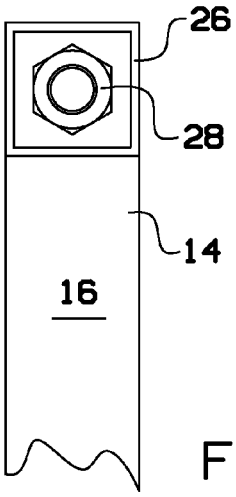
FIG. 4 is an end view of a male door locking prevention device half of the door locking prevention device of FIG. 1.

In the embodiment of the present invention shown in FIGS. 1-3, the door locking prevention device 10 may be applied to a door and the bolt 20 may be turned with an appropriate tool to secure the device 10 to the door. Another person, intentionally or unintentionally, would need the appropriate tool to loosen the bolt 20 and remove the device 10. In other words, the device 10 may be applied to a door and not be able to be removed by a person by hand.

The door locking prevention device 10 may include a battery power supply 48 that may connect, via a wire 46, for example, to an indicator 44. The indicator 44 may be a light emitting diode (LED), a strobe, or some other light source. In some embodiment, the indicator 44 may include a GPS device, allowing the location of the device 10 to be recorded and tracked. The indicator 44 may include reflectors as well. While only two indicators 44 are shown in the device 10 of FIG. 1, a plurality of indicators 44, of various types, may be disposed on a single device. In some embodiments, the indicators 44 may be powered by the power supply 48 only when the device 10 is installed on a door. For example, a pressure sensitive switch may detect when the device 10 is installed by measuring pressure opposing the brackets 12, 14.

Figure 6:
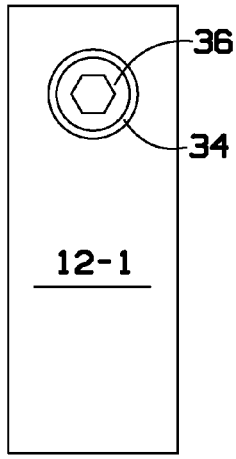
FIG. 6 is a front view of a female door locking prevention device half of the door locking prevention device of FIG. 1.
Figure 5:
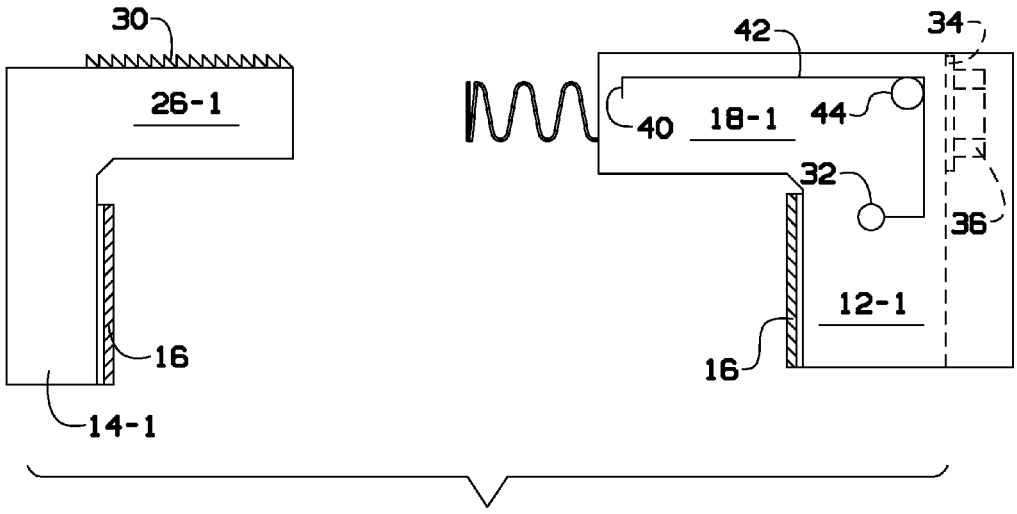
FIG. 5 is a perspective view of a door locking prevention device, prior to assembly on a door, according to an alternate embodiment of the present invention.

Referring now to FIGS. 5 and 6, various features may be provided to help prevent the device from being opened. For example, the male member 26-1 of a bracket 14-1 may include teeth 30 disposed on one or more sides thereof. The female member 18-1 of a bracket 12-1 may include a catch 40. As the male member 26-1 is tightened into the female member 18-1, the catch 40 may lock against a flat side of the teeth 30, preventing the brackets 12-1, 14-1 from being pulled apart. A linkage 42 may be provided to connect the catch 40 to a key hole 32, where turning a key (not shown) may cause the linkage 42 to lift the catch 40 and release the catch 40 from the teeth 30. A spring 44 may be disposed to resiliently maintain the catch 40 in an engagement position with the teeth 30. However, turning the key may act against the resilient force of the spring 44 to cause the catch 40 to lift out of the way of the teeth 30.

In the embodiment of FIGS. 5 and 6, a user would not only have to loosen a bolt 36, but also, they would have to have a key to release the catch 40 from the teeth 30. This configuration provides additional security to prevent unauthorized removal of the device.

Still in FIGS. 5 and 6, in some embodiments, the bolt 36 may be encased within the bracket 12-1 there an access hole 34 is provided to reach the head of the bolt 36. In this embodiment, a tool, such as an Allen wrench, Torx wrench, or the like, is needed to turn the bolt 36. This provides yet an additional security feature, where a simple pair of pliers could not be used to loosen the bolt 36. While not shown in FIGS. 5 and 6, the device may also include a power source and indicators, such as lights, reflectors, GPS positioning units, or the like.

While FIGS. 5 and 6 shows a particular locking mechanism, other locking and release mechanisms are contemplated within the scope of the present invention. For example, a $CO_2$ cartridge, a miniature pneumatic cylinder, a miniature actuator, or the like, may be employed to activate and/or release a locking mechanism that can hold the brackets 12, 14 together.

The door locking prevention device may be made of various materials. For example, the door locking prevention device may be made of plastic, resin, metal or the like. Depending on the application, a non-sparking metal, such as bronze, or plastic may be used in potentially explosive environments.

It should be understood, of course, that the foregoing relates to exemplary embodiments of the invention and that modifications may be made without departing from the spirit and scope of the invention as set forth in the following claims.

What is claimed is:

1. A door locking prevention device comprising:

a first bracket adapted to contact a first side of an open door, the first bracket having a male member extending therefrom;

a second bracket adapted to contact a second side of the door opposite the first side of the door when placing the door locking prevention device on an outer periphery of an open door, the second bracket having a female member extending therefrom, wherein the male member fits inside the female member;

a threaded bolt extending into the female member;

a threaded connector disposed in the male member, the threaded connector adapted to threadably engage with the threaded bolt;

a spring disposed about the threaded bolt, the spring adapted to push the first bracket away from the second bracket;

a plurality of teeth along an edge of the male member; and a catch disposed inside the female member, the catch adapted to releasably engage the teeth and prevent the male member from being pulled away from the female member.

2. The door locking prevention device of claim 1, wherein each of the first bracket and the second bracket are L-shaped.

3. The door locking prevention device of claim 1, further comprising a pad disposed on an inside edge of each of the first bracket and the second bracket.

4. The door locking prevention device of claim 1, wherein the threaded bolt is disposed inside the second bracket and accessed via an access hole formed in the second bracket.

5. A door locking prevention device for attachment to a door, the device comprising:

a first bracket having an L-shape and a male member extending therefrom, wherein the first bracket adapted to contact a first side of an open door;

a second bracket having an L-shape and a female member extending therefrom, wherein the male member fits inside the female member and the second bracket adapted to contact a second side of the door opposite the first side of the door when placing the door locking prevention device on an outer periphery of an open door;

a threaded bolt extending into the female member;

a threaded connector disposed in the male member, the threaded connector adapted to threadably engage with the threaded bolt to move the first bracket toward the second bracket, wherein the door locking prevention device fixes onto an outer periphery of the open door by moving the first bracket toward the second bracket;

a spring disposed about the threaded bolt, the spring adapted to push the first bracket away from the second bracket; and a locking mechanism to selectively prevent the first bracket from being separated from the second bracket.

* * * * *